US006994116B2

(12) United States Patent
Büttner

(10) Patent No.: US 6,994,116 B2
(45) Date of Patent: Feb. 7, 2006

(54) DISTRIBUTING VALVE FOR THE LOAD-INDEPENDENT CONTROL OF A HYDRAULIC CONSUMER IN TERMS OF DIRECTION AND SPEED

(75) Inventor: Peter Büttner, Lohr am Main (DE)

(73) Assignee: Bosch Rexroth AG, Lohr/Main (DE)

( * ) Notice: Subject to any disclaimer, the term of this patent is extended or adjusted under 35 U.S.C. 154(b) by 150 days.

(21) Appl. No.: 10/468,175

(22) PCT Filed: Jan. 25, 2002

(86) PCT No.: PCT/EP02/00792

§ 371 (c)(1),
(2), (4) Date: Aug. 16, 2003

(87) PCT Pub. No.: WO02/066842

PCT Pub. Date: Aug. 29, 2002

(65) Prior Publication Data

US 2004/0069359 A1 Apr. 15, 2004

(30) Foreign Application Priority Data

Feb. 17, 2001 (DE) ..... 101 07 532

(51) Int. Cl.
*F15B 13/04* (2006.01)

(52) U.S. Cl. ..... 137/625.69; 137/596.13; 91/446

(58) Field of Classification Search ..... 137/596.13, 137/625.69; 91/446
See application file for complete search history.

(56) References Cited

U.S. PATENT DOCUMENTS

| | | | | |
|---|---|---|---|---|
| 3,212,522 A | | 10/1965 | Williams | |
| 4,051,868 A | | 10/1977 | Andersen | |
| 4,355,660 A | | 10/1982 | Huffman | |
| 4,981,159 A | * | 1/1991 | Christensen et al. | 91/446 |

FOREIGN PATENT DOCUMENTS

| | | |
|---|---|---|
| DE | 3841507 | 6/1989 |
| DE | 3802672 | 8/1989 |
| DE | 4413216 | 10/1995 |
| DE | 19800720 | 7/1999 |
| DE | 19948232 | 1/2001 |
| EP | 0638730 | 2/1995 |
| EP | 0786598 | 7/1997 |
| EP | 1108895 | 6/2001 |

OTHER PUBLICATIONS

Data Sheet RD 64 282/10.99 of applicant Mannesmann Rexroth.

* cited by examiner

*Primary Examiner*—Ramesh Krishnamurthy
(74) *Attorney, Agent, or Firm*—Martin A. Farber

(57) ABSTRACT

A directional control valve for a hydraulic load has, in a piston bore of a valve housing, a control piston which can be displaced axially in opposite directions from a central position and which has first fine control grooves for opening a connection between a load chamber and a feed chamber. There are second fine control grooves for opening a connection between a load chamber and a discharge chamber of the piston bore under control. In its central position, there is a restricted relief connection from a load chamber to the discharge chamber via the control piston. The restricted relief connection is obtained via a recess in the control piston, independently of the second fine control grooves.

4 Claims, 2 Drawing Sheets

DISTRIBUTING VALVE FOR THE LOAD-INDEPENDENT CONTROL OF A HYDRAULIC CONSUMER IN TERMS OF DIRECTION AND SPEED

FIELD AND BACKGROUND OF THE INVENTION

The invention is based on a directional control valve which is used for the load-independent control of a hydraulic load in terms of direction and speed, comprising a control piston (22) which can be displaced axially in opposite directions from a central position in a piston bore (21) of a valve housing (20). with which the pressure medium paths can be controlled between a feed chamber (27), to which pressure medium can be fed from a pressure medium source, a discharge chamber (32, 33), via which pressure medium can be led away to a tank, and two load chambers (28, 29), which has first fine control grooves (55) for opening a connection between a load chamber (28, 29) and the feed chamber (27) under control, and second fine control grooves (56) for opening a connection between a load chamber (28, 29) and the discharge chamber (3, 33) under control, and via which, in the central position, there is a restricted relief connection from a load chamber (28, 29) to the discharge chamber (32, 33).

In practice, in the control piston of the variant with a relieved central position, as compared with the control piston which, in the central position, shuts off the load chambers present, the second fine control grooves are lengthened to such an extent that, even in the central position of the control piston, they project into the load chambers. The disadvantage in this case is that, in the event of valve actuation, at the start of opening the first fine control grooves, the flow cross section between the feed chamber and one load chamber is very small as compared with the flow cross section between the other load chamber and a discharge chamber. Precise control and fully restrained displacement of the hydraulic load is not possible in this stroke region. If further shut-off valves or braking valves are connected between the directional control valve and the hydraulic load, then a great deal of effort has to be expended for coordinating these valves in relation to the flow cross sections at the directional control valve. It is also disadvantageous that, as compared with a control piston with a blocked central position, a completely new design of the second fine control grooves is necessary.

SUMMARY OF THE INVENTION

The invention is based on the object of developing a directional control valve which has the features of the introductory-mentioned type, in such a way that, even at the start of opening the first fine control grooves, precise control of the hydraulic load is possible, and wherein the effort for designing the fine control grooves is reduced.

In a directional control valve of the introductory-mentioned type according to the invention, the intended object can be achieved, wherein, the relief connection exists via a recess in the control piston, independently of the second fine control grooves, and, in the event of displacement of the control piston with the effect of connecting a load chamber to a discharge chamber, the relief connection is interrupted before the second fine control grooves open a flow cross section. Accordingly, in the case of the variant with a relieved central position, the second fine control grooves no longer have anything to do with relieving a load chamber.

Their design can therefore be based only on the dimensions necessary for the desired control of the hydraulic load. At a predefined maximum flow rate, the second fine control grooves for the valve variant with a relieved central position and for the valve variant with a blocked central position can be the same.

According to a feature of the invention the recess in the central position of the control piston is directly open both to a load chamber and to a discharge chamber and, in the event of displacement of the control piston from the central position, is shut off with respect to one of the chambers. Here, therefore, the restricted relief is carried out in a short way merely via the recess.

The recess can be a recess which is provided in addition to the recesses already present on the control piston in the known directional control valve. In a particularly preferred way, however, a recess which known directional control valves already also have, namely a recess which serves to feed back a load pressure, is changed slightly in such a way that it is able to bring about the relief of the load chamber.

In this case, the relief can take place directly via the recess. This appears to be particularly expedient in the case of a directional control valve which, without a relieved central position, is disclosed by DE 38 41 507 C1 and in which the load feedback is carried out via radial ducts in the control piston, which are located in the region of the housing lands between the load chambers and the discharge chambers. There, the radial ducts in the outer opening region have to be made axially only so large that, in the central position of the control piston, they are open both to the load chamber and to the discharge chamber.

In the case of load feedback as is made in the directional control valve according to the data sheet or in the case of a directional control valve disclosed by EP 0 638 730 A1, relief of a load chamber is likewise obtained in a simple manner, according to features of the invention, by involving the fluid path for the load feedback and by adapting the radial duct tapping off the pressure in the load chamber.

BRIEF DESCRIPTION OF THE DRAWINGS

Two exemplary embodiments of a directional control valve according to the invention are illustrated in the drawings. The invention will now be explained in more detail by using the figures of these drawings, in which.

DETAILED DESCRIPTION OF THE PREFERRED EMBODIMENT

Figure 1:
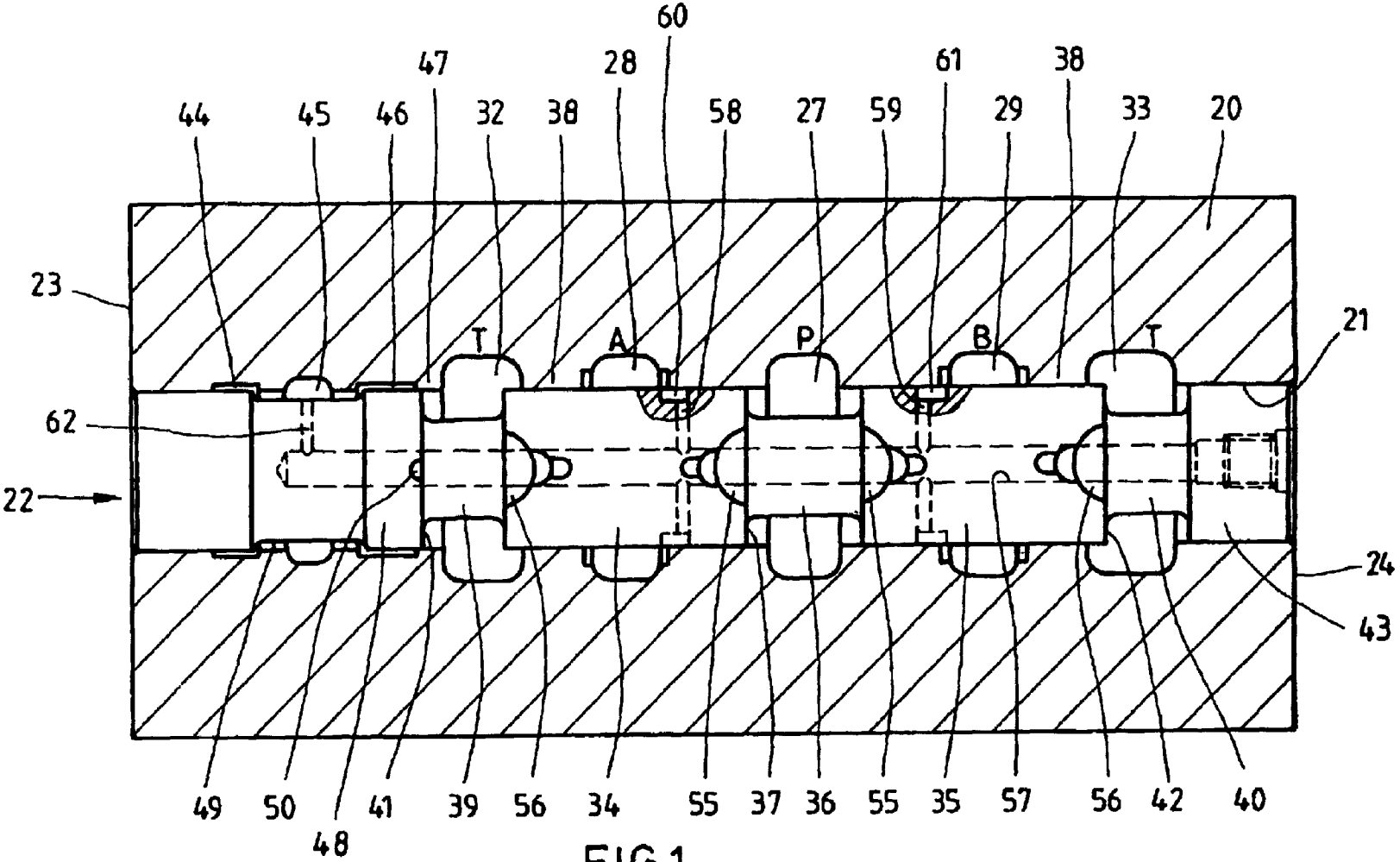
FIG. 1 shows the first exemplary embodiment, in which the load chambers are relieved via the fluid path for load feedback.

According to the figures, a piston bore 21, in which a control piston 22 can be moved axially, passes through a valve housing 20 of a continuously adjustable directional control valve used within a load-sensing control system for a hydraulic load. The length of the control piston 22 agrees with the length of the piston bore 21 from one end 23 as far as the other end 24 of the valve housing 20. The piston bore 21 is surrounded by five control chambers which are spaced apart axially from one another, are used for the feed of pressure medium to and the discharge of pressure medium from a hydraulic load, and whose connections to one another are controlled by the control piston 22. The central of the five control chambers is the feed chamber 27. On either side of this feed chamber there is in each case a load chamber 28 and 29, respectively. Each load chamber 28 and 29 is further adjoined by a discharge chamber 32 and 33, respectively, which is open to a tank duct which passes through the valve housing 20 but is not specifically illustrated.

On account of two centering springs, which are not shown, are accommodated in covers which are fixed to the ends 23 and 24 of the valve housing 20 and close the piston bore 21 to the outside, the control piston 22 assumes a central position. In this central position, two piston collars 34 and 35 which belong to the control piston 22 and between which, in the region of the feed chamber 27, there is a piston neck 36 with a circumferential annular groove 37 block off the two load chambers 28 and 29 with respect to the feed chamber 27. The two piston collars 34 and 35 are so long that, in the central position of the control piston, they are intrinsically also able to isolate the load chambers 28 and 29 from the discharge chambers along the housing lands 38. Each piston collar 34 and 35 is adjoined by a further piston neck 39 and 40 with an annular groove 41 and 42, which is in each case located in the region of a discharge chamber. The piston neck 40 is adjoined by a further piston collar 43, which seals off the spring chamber in one cover with respect to the discharge chamber 33.

The distance between the discharge chamber 32 and the end 23 is greater than the distance between the discharge chamber 33 and the end 24 of the valve housing 20. Between the discharge chamber 32 and the end 23, in the piston bore 21, there are three annular chambers 44, 45 and 46 which are spaced apart axially from one another, it being possible for the central one of these three chambers to be designated a load feedback chamber 45 since, from there, the load pressure is fed back to an individual pressure compensator, associated with the directional control valve but not shown, and, if the load pressure is the highest, is fed back to a pump controller. The annular chamber 44 located toward the end 23 of the valve housing 20, as viewed from the load feedback chamber 45, can be connected to the input of a pressure limiting valve. A pressure limiting valve can also be connected to the annular chamber 46 located between the load feedback chamber 45 and the discharge chamber 32. In the illustrated central position of the control piston 22, a piston section which follows the piston neck 39 reaches from the end 23 of the valve housing 20 into the region of the housing land 47 between the annular chamber 46 and the discharge chamber 32. A flat annular groove 49 is machined into this piston section, via which groove all three annular chambers 44, 45 and 46 are connected to one another in the central position of the control piston 22. Between the annular groove 49 and the piston neck 39 there is a piston collar 48, whose effective sealing length is less than the width of the annular chamber 46. At its outer edge facing the discharge chamber 32, the piston collar 48 has two diametrically opposite milled recesses 50, through which the annular chamber 46 and discharge chamber 32 are open to each other with a small opening cross section when the control piston 22 is in its central position. If the control piston 22 is moved out of its central position, then the load feedback chamber 45 is isolated from the annular chamber 44 or from the annular chamber 46, depending on the direction of movement of the control piston. In addition, irrespective of the direction of movement, the connection existing in the central position of the control piston 22 via the annular chamber 46 between the load feedback chamber 45 and the discharge chamber 32 is closed, by the load feedback chamber 45 being isolated from the annular chamber 46 or the annular chamber 46 being isolated from the discharge chamber 32.

At both ends of each of the two piston collars 34 and 35 there are two diametrically opposite fine control grooves 55 and 56, whose cross section becomes greater toward the front edges. The fine control grooves reach from the front edges into the piston collars only to such an extent that their inner end is still at a distance from the load chambers 28 and 29, respectively, in the central position of the control piston 22. In the central position of the control piston 22, therefore, the load chambers have a fluidic connection via the fine control grooves neither to the feed chamber 27 nor to the adjacent discharge chamber 32 or 33.

Through the control piston 22 there passes an axial bore 57, which is closed at both ends. In the region of the annular groove 49, the control piston 22 has a narrow radial bore 62 which reaches into the axial bore 57 from outside and which acts as a nozzle or restrictor. The axial bore 57 is additionally crossed by two radial bores 58 and 59, of which the radial bore 58 passes through the piston collar 34 and the radial bore 59 passes through the piston collar 35 of the control piston 22. As viewed in the axial direction, the radial bores 58 and 59 are still located within the extent of the fine control grooves 55, but are offset by 90 degrees with respect to the latter. They have a diameter such that, and a distance from the front edge of the respective piston collar 34 and 35 that faces the feed chamber 27 such that, in the central position of the control piston 22, they would intrinsically be at a short distance from a load chamber 28, 29, covered by the wall of the piston bore 21. This is the case in the exemplary embodiment according to FIG. 2.

In the exemplary embodiment according to FIG. 1, however, a blind hole 60 and 61 of low depth is introduced eccentrically at the two opposite openings of each radial bore 58 and 59 and covering the radial bores, its diameter being greater than the diameter of the radial bores. In the central position of the control piston 22, there is a flow cross section between the blind holes 60 and the load chamber 28 and between the blind holes 61 and the load chamber 29.

Thus, in the exemplary embodiment according to FIG. 1, in the central position of the control piston 22, the load chamber 28 is connected fluidically to the discharge chamber 32 via the blind holes 60 and the radial bore 58, and the load chamber 28 is connected fluidically to the discharge chamber 32 via the blind holes 61 and the radial bore 59 and, just like the load chamber 28, further via the axial bore 57, the radial bore 62, via the annular groove 49 of the control piston 22, via the annular chamber 46 of the piston bore 21 and via the milled recesses 50. Because of the nozzle action of the radial bore 62, the connection is a restricted connection. Via the connection, pressurized liquid can therefore flow away from the load chambers in a small stream to the discharge chamber 32 and therefore to a tank. As a result, the load chambers are relieved of pressure, so that, for example, shut-off or braking valves which are arranged between the load chambers and a hydraulic load function reliably. A load which is supported on a load chamber when a shut-off valve is not present moves only slowly.

Relieving the load chambers is carried out without involving the fine control grooves 56, so that these can be designed in exactly the same way as in the case of a directional control valve without restricted relief of the central position. The control piston 22 of the exemplary embodiment of the invention according to FIG. 1 differs from the control piston of such a directional control valve only in the additional blind holes 60 and 61.

If the control piston 22 is moved out of the central position, for example to the right in the view according to FIG. 1, then the blind holes 60 are covered and the flow cross section between them and the load chamber 28 is closed, even before this load chamber is connected to the discharge chamber 32 via the fine control grooves 56 in the piston collar 34. The connection between the annular groove 49 in the control piston 22 and the discharge chamber 32 is likewise closed. By contrast, the radial bore 59 remains open to the load chamber 29, which is connected to the feed chamber 27 only via the fine control grooves 55, so that load feedback is possible. In the event of displacement of the control piston 22 from the central position to the left, the blind holes 61 will be covered and the radial bores 58 will remain open to the load chamber 28.

Figure 2:
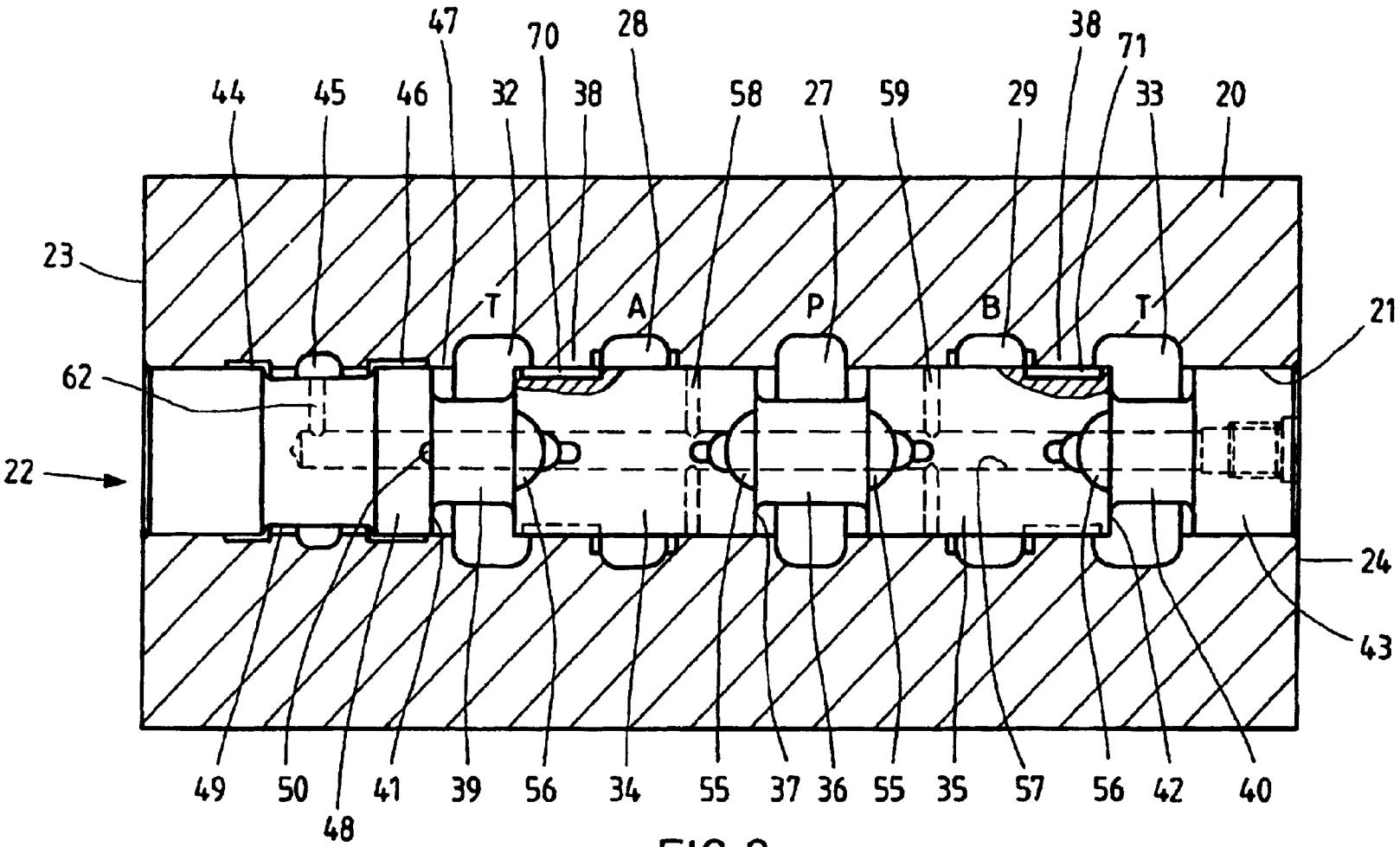
FIG. 2 shows the second exemplary embodiment, in which the load chambers are relieved via additional recesses in the control piston.

In the exemplary embodiment according to FIG. 2, the radial bores 58 and 59 reach as far as the outer side of the piston collars 34 and 35 and, in the central position of the control piston 22, are covered by the piston bore 21. For the restricted relief of the load chambers 28 and 29 in the central position, each piston collar 34 and 35 has two opposite, narrow grooves 70 and 71 which run axially and via which, in the central position of the control piston 22 along the housing lands 38, there is a direct restricted connection between the load chambers and the discharge chambers. In the central position of the control piston, the grooves 70 and 71 extend into the load chambers and the discharge chambers only to such an extent that the fluid connection via them is also interrupted in the event of displacement of the control piston 22 out of the central position before fine control grooves 55 and 56 open toward the load chambers. Even in the exemplary embodiment according to FIG. 2, therefore, the restricted relief of the load chambers is carried out without involving the fine control grooves 56.

What is claimed is:

1. A directional control valve for control, in particular load-independent control, of a hydraulic load in terms of direction and speed, comprising a control piston (22) which is displaceable axially in opposite directions from a central position in a piston bore (21) of a valve housing (20), with which pressure medium paths are controlable between a feed chamber (27), to which pressure medium is feedable from a pressure medium source, a discharge chamber (32, 33), via which pressure medium is leadable away to a tank, and two load chambers (28, 29), which has first fine control grooves (55) for opening a connection between a load chamber (28, 29) and the feed chamber (27) under control, and second fine control grooves (56) for opening a connection between a load chamber (28, 29) and the discharge chamber (32, 33) under control, and via which, in the central position, there is a restricted relief connection from a load chamber (28, 29) to the discharge chamber (32, 33), wherein the relief connection exists via a recess (60, 61, 70, 71) in the control piston (22), independently of the second fine control grooves (56), and in event of displacement of the control piston (22) with the effect of connecting the load chamber (28, 29) to the discharge chamber (32, 33), the relief connection is interrupted before the second fine control grooves (56) open a flow cross section, and wherein in event of displacement of the control piston (22) with effect of connecting a load chamber (28, 29) to the feed chamber (27), the recess (60, 61) remains open to the load chamber (28, 29), and the recess (60, 61) lies in a fluid path serving to feed back a load pressure.

2. The directional control valve as claimed in claim 1, wherein the fluid path has a radial bore (58, 59) to tap off the load pressure prevailing in a load chamber (28, 29), and the recess (60, 61) is formed by an enlargement of only an opening region of the radial bore (58, 59).

3. The directional control valve as claimed in claim 1, wherein in region of a load chamber (28), the control piston (22) has a first piston collar (34) with first fine control grooves (55) and second fine control grooves (56), a first annular groove (41) adjoining the first piston collar (34) in region of a discharge chamber (32), a further piston collar (48) adjacent to said annular groove (41) and a further annular groove (49) adjacent thereto, wherein the recess (60) belongs to a first radial duct (58) of the first piston collar (34), the control piston (22) has an axial bore (57) which is met by the first radial duct (58) and, at an axial distance from the first radial duct (58), is met by a second radial duct (62), which on an outside opens into the further annular groove (49), wherein, isolated from the discharge chamber (32) by a housing land (47), around the piston bore (21) there runs an annular chamber (46) whose width is greater than effective width of the further piston collar (48), and wherein the further piston collar (48) and the annular chamber (46) are located in relation to each other such that in the central position of the control piston (22) the further annular groove (49) is open to the discharge chamber (32) via the annular chamber (46) but, following a short travel of the control piston (22) from the central position, is isolated from the discharge chamber (32) by the further piston collar (48).

4. The directional control valve as claimed in claim 2, wherein in region of a load chamber (28), the control piston (22) has a first piston collar (34) with first fine control grooves (55) and second fine control grooves (56), a first annular groove (41) adjoining the first piston collar (34) in region of a discharge chamber (32), a further piston collar (48) adjacent to said annular groove (41) and a further annular groove (49) adjacent thereto, wherein the recess (60) belongs to a first radial duct (58) of the first piston collar (34) the control piston (22) has an axial bore (57) which is met by the first radial duct (58) and, at an axial distance from the first radial duct (58), is met by a second radial duct (62), which on an outside opens into the further annular groove (49), wherein, isolated from the discharge chamber (32) by a housing land (47), around the piston bore (21) there runs an annular chamber (46) whose width is greater than effective width of the further piston collar (48), and wherein the further piston collar (48) and the annular chamber (46) are located in relation to each other such that in the central position of the control piston (22), the further annular groove (49) is open to the discharge chamber (32) via the annular chamber (46) but, following a short travel of the control piston (22) from the central position, is isolated from the discharge chamber (32) by the further piston collar (48).

* * * * *